US005480321A

United States Patent [19]

Rouhier et al.

[11] Patent Number: 5,480,321

[45] Date of Patent: Jan. 2, 1996

[54] SOCKET SUITABLE FOR REMOTE MANIPULATION AND PLUG-SOCKET SYSTEM COMPRISING IT

[75] Inventors: Maurice Rouhier, Viroflay; Jean-Louis Striebig, Chennevieres, both of France

[73] Assignee: Framatome Connectors International, Paris la Defense, France

[21] Appl. No.: 145,736

[22] Filed: Nov. 4, 1993

[30] Foreign Application Priority Data

Nov. 4, 1992 [FR] France ..... 92 13225

[51] Int. Cl.[6] ..... H01R 13/64

[52] U.S. Cl. ..... 439/374; 439/376

[58] Field of Search ..... 439/160, 374, 439/378, 380

[56] References Cited

U.S. PATENT DOCUMENTS 4,905,938 3/1990 Braccio et al. ..... 439/374 X

FOREIGN PATENT DOCUMENTS 2532482 12/1982 France .
2546675 5/1983 France .
9116006 9/1982 Germany .

OTHER PUBLICATIONS

Search Report FR 92 13225.

*Primary Examiner*—David L. Pirlot
*Attorney, Agent, or Firm*—Pollock, Vande Sande & Priddy

[57] ABSTRACT

A socket which can be manipulated under remote control includes a plug insertion guide fork. One branch of the fork has an extension provided with an angular polarizer arrangement. This is a slot having a width allowing a cranked back part of the plug to pass through it. The socket is used in a plug-socket system in which when the plug is mounted on the socket the extension forms a mechanical support for at least part of the body of the plug.

11 Claims, 1 Drawing Sheet

SOCKET SUITABLE FOR REMOTE MANIPULATION AND PLUG-SOCKET SYSTEM COMPRISING IT

BACKGROUND OF THE INVENTION

1. Field of the Invention

The present invention concerns a socket which can be remotely manipulated and is of the type having a plug insertion guide fork.

2. Description of the Prior Art

In the nuclear technology field, plug and socket systems are used to make connections in the "hot" areas, i.e., areas exposed to radiation. These systems seal the passage through a wall separating the hot area from the cold area (not exposed to radiation) and can be manipulated remotely by automated installations. Thus, the socket and the plug can be connected and disconnected without human intervention.

The plug-socket systems used include systems which are locked by locking lugs and which are unlocked by sliding a sleeve. A system of this kind is described for example, in U.S. Pat. No. 1,220,817.

To enable the system to be manipulated under remote control, the socket comprises in the known manner a plug insertion guide fork having an upper branch and a lower branch of the same length, and the plug has two flats adapted to receive the branches of a remote manipulator tool. One branch has a groove designed to cooperate with a guide pin fastened to the sliding sleeve.

The present invention is directed to improving the presentation of the plug to the socket and in particular the guide (polarizer) function.

SUMMARY OF THE INVENTION

In one of its aspects, the invention consists in a socket adapted to be manipulated under remote control and having a plug insertion guide fork, wherein one branch of the fork has an extension provided with angular polarizer means and the extension comprises two arms separated by a slot constituting the angular polarizer means.

In a first embodiment of the invention, the angular polarizer means comprise a housing at the distal end of the extension configured to receive a polarizer pin.

The slot may have a width enabling the passage of a cranked back part of the plug, such as a cable entry.

At least one arm may have a plug body bearing region. The bearing region may extend over a major part of the length of the extension.

The extension may advantageously have a contour such that it is in contact with at least one region of the body of the plug when the latter is mounted on the socket. In this way the socket supports the weight of the plug and the cable, which prevents misalignment due to flexing.

In another aspect, the invention consists in a plug-socket system comprising a socket as defined hereinabove and a plug comprising a member adapted to engage in the angular polarizer means. The extension may form a mechanical support for at least part of the body of the plug when fitted to the socket.

Other features and advantages of the invention will emerge more clearly from the following description given by way of example only with reference to the accompanying drawings.

DETAILED DESCRIPTION OF THE INVENTION

Figures 1, 2, 3, 4:
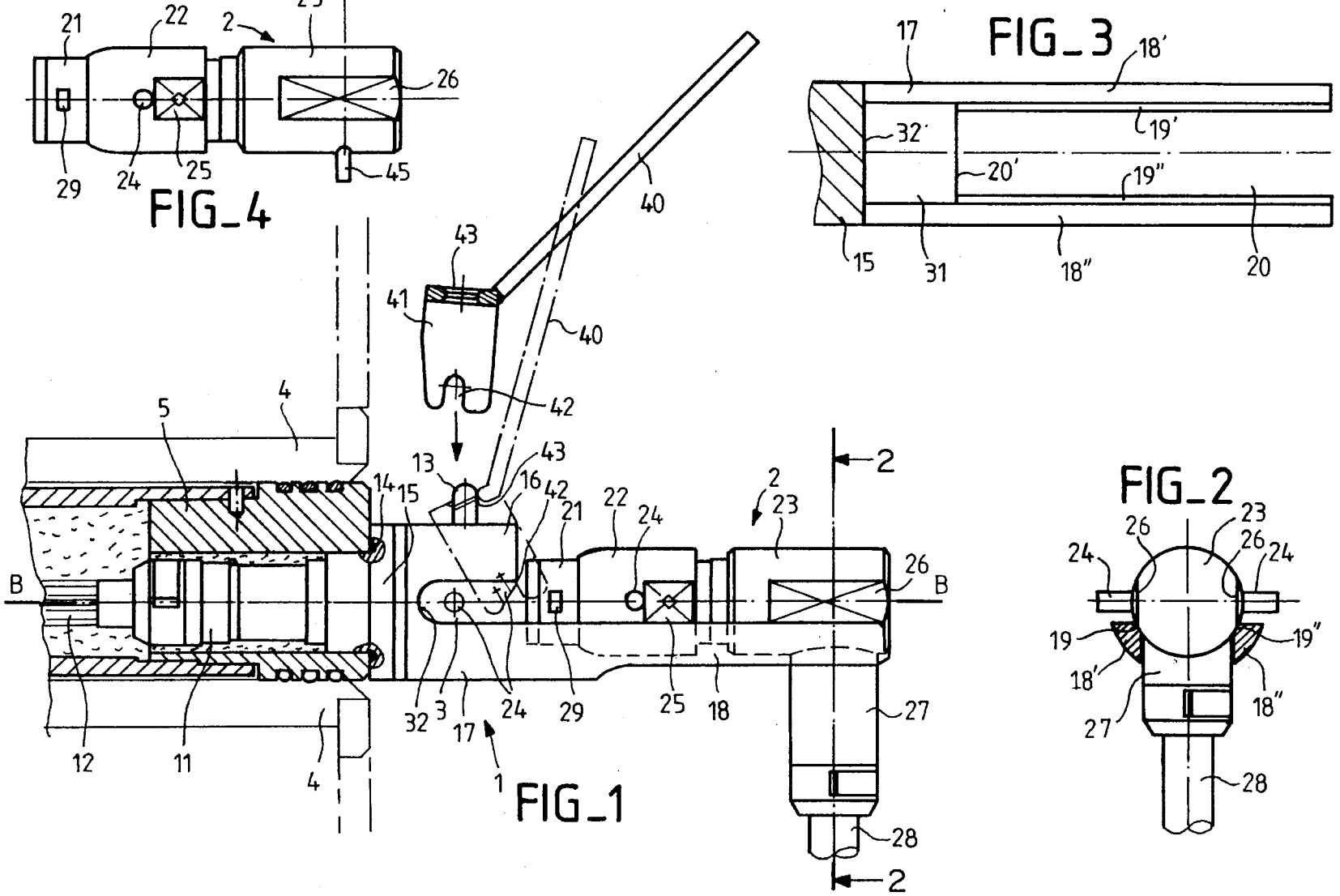
FIG. 1 is a partially cut-away side view of a preferred embodiment of a plug-socket system in accordance with the invention.
FIG. 2 is a vertical cross-section on the line A—A in FIG. 1.
FIG. 3 is a partial horizontal cross-section of a preferred embodiment of the socket in accordance with the invention on the line B—B in FIG. 1.
FIG. 4 shows an alternative embodiment of a plug in accordance with the invention.

As shown in FIG. 1, a socket 1 has a socket body 11 screwed to a sleeve 5 housed in and sealed to a wall 4. The socket body 11 has a connecting cable 12 at the back and a plug insertion guide fork 15 and seals 14 at the front. In the known manner, the fork 15 has an upper branch 16 and a lower branch 17 which, according to the invention, has an extension 18 along a longitudinal direction of the socket and below its longitudinal axis. The plug 2 has a front part 21 including locking lugs 29, an unlocking sleeve 22 having unlocking flats 25 enabling the sleeve 22 to be manipulated by a remote manipulator device and a cylindrical back part 23 with flats 26 so that it can be manipulated by a remote manipulator tool. The back part 23 has a 90° cable entry 27 terminating a cable 28.

As shown in FIGS. 2 and 3, the branch 17 has a cylindrical profile region 31 for receiving the front part 21 of the plug 2. The extension 18 has two side arms 18' and 18" separated by a slot 20. The inner part of the arms 18' and 18" has cylindrical profile chamfers 19' and 19" enabling it to receive the back part 23 and to support it mechanically. The cable entry 27 at right angles to the back part 23 has a width substantially equal to that of the slot 20, providing an angular polarizer function, i.e., the cylindrical member 27 locates angularly of its own accord in the slot 20 when the plug 2 is pushed in.

When the plug 2 is mounted on the socket 21, its cylindrical rear part 23 rests on the chamfers 19' and 19" so that the weight of the plug 2 and in particular that of the cable 28 are supported by the arms 18' and 18". This is particularly advantageous because, given the presence of the 90° cable entry 27, the cable 28 is substantially vertical over a significant portion of its length and exerts a torque tending to deform the plug body 2. This torque is compensated by the arms 18' and 18".

In the manner that is known in itself the sleeve 22 has side pins 24 and the upper branch 16 has in its upper part a pin 13 adapted to engage in an opening 43 on an unlocking lever 40 which can be manipulated under remote control and which has at its lower end a stirrup member 41 having two notches 42 fitting over the pegs 24. FIG. 1 shows the lever 40 in dashed outline in the position in which the plug is unlocked by translatory movement of the sleeve 22.

FIG. 4 shows an alternative embodiment of the invention in which the back part 23 has a polarizer peg 45 designed to cooperate with a groove or slot 20 in the extension 18 of the lower branch 17.

There is claimed:

1. Socket adapted to be manipulated under remote control and having a plug insertion guide fork, wherein one branch of said fork has an extension provided with angular polarizer means and said extension comprises two angular polarizer means and said extension comprises two arms separated by a slot constituting said angular polarizer means, at least one of said arms having a plug bearing region.

2. Socket according to claim 1, wherein said angular polarizer means comprise a slot at a distal end of said extension configured to receive a polarizer pin.

3. Socket according to claim 1, wherein said slot has a width enabling a cranked back part of said plug comprising a cable entry to pass through said slot.

4. Socket according to claim 1, wherein said bearing region extends over a major part of a length of said extension.

5. Socket according to claim 1, wherein said extension has a contour such that it is in contact with at least one region of a body of said plug when said plug is mounted on said socket.

6. Plug-socket system comprising a socket adapted to be manipulated under remote control and hating a plug insertion guide fork, wherein one branch of said fork has an extension provided with angular polarizer means and said extension comprises two arms separated by a slot constituting said angular polarizer means and a plug comprising a member adapted to engage in said angular polarizer means, and wherein, when said plug is mounted on said socket, said extension forms a mechanical support for at least part of said body of said plug, said extension having a contour such that it is in contact with at least one region of the body of said plug when the plug is mounted on said socket.

7. System according to claim 6, wherein said angular polarizer means comprise a slot at a distal end of said extension configured to receive a polarizer pin.

8. System according to claim 6, wherein said slot has a width enabling a cranked back part of said plug to pass through it.

9. System according to claim 8, wherein said cranked back part of said plug is configured to serve as a cable entry.

10. System according to claim 6, wherein at least one arm has a plug body bearing region.

11. System according to claim 10, wherein said bearing region extends over a major part of the length of said extension.

* * * * *